US005574541A

United States Patent [19]

Folkins

[11] Patent Number: 5,574,541

[45] Date of Patent: Nov. 12, 1996

[54] CORONA DUAL-USE FOR COLOR IMAGE FORMATION

[75] Inventor: Jeffrey J. Folkins, Rochester, N.Y.

[73] Assignee: Xerox Corporation, Stamford, Conn.

[21] Appl. No.: 477,956

[22] Filed: Jun. 7, 1995

[51] Int. Cl.[6] ..... G03G 15/02; G03G 15/14

[52] U.S. Cl. ..... 399/171; 399/296

[58] Field of Search ..... 355/326 R, 327, 355/271, 273, 274

[56] References Cited

U.S. PATENT DOCUMENTS

| | | | |
|---|---|---|---|
| 4,141,648 | 2/1979 | Gaitten et al. | 355/225 |
| 4,432,631 | 2/1984 | Bacon et al. | 355/225 |
| 4,488,802 | 12/1984 | Sunaga et al. | 355/271 X |
| 4,835,571 | 5/1989 | Tagawa et al. | 355/225 |
| 5,258,820 | 11/1993 | Tabb | 355/328 |
| 5,357,318 | 10/1994 | Haneda et al. | 355/274 X |
| 5,402,222 | 3/1995 | Haneda et al. | 355/327 |

FOREIGN PATENT DOCUMENTS 3-202869 9/1991 Japan .

OTHER PUBLICATIONS

Xerox Disclosure Journal–vol. 1, No. 2., Feb. 1976 "Copier with Single Corona generating Device Author: F. Noto".

*Primary Examiner*—Matthew S. Smith
*Assistant Examiner*—Sophia S. chen

[57] ABSTRACT

In a multi-color imaging method and apparatus utilizing a charging step between two image creation steps, a corona generating device performs two different functions in different passes of the photoreceptor. The printing system may be a single pass system where all of the colors are developed in a single pass or a multi-pass system where each color is developed in a separate pass. The charging step may have more than one charging application as in a split recharge system.

20 Claims, 5 Drawing Sheets

CORONA DUAL-USE FOR COLOR IMAGE FORMATION

BACKGROUND OF THE INVENTION

This invention relates generally to color imaging and the use of plural exposure and development steps for such purposes and more particularly to the use of one of the corona generating devices performing more than one function.

One method of printing in different colors is to uniformly charge a charge retentive surface and then expose the surface to information to be reproduced in one color. This information is rendered visible using marking particles followed by the recharging of the charge retentive surface prior to a second exposure and development. This recharge/expose/ and develop (REaD) process may be repeated to subsequently develop images of different colors in superimposed registration on the surface before the full color image is subsequently transferred to a support substrate. The different colors may be developed on the photoreceptor in an image on image development process, or a highlight color image development process (image next-to image). Each different image may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

Several issues arise that are unique to the REaD image on image process of creating multi-color images in the attempt to provide optimum conditions for the development of subsequent color images onto previously developed color images. For example, during a recharge step, it is important to level the voltages among previously toned and untoned areas of the photoreceptor so that subsequent exposure and development steps are effected across a uniformly charged surface. The greater the difference in voltage between those image areas of the photoreceptor previously subjected to a development and recharge step; and those bare non-developed, untoned areas of the photoreceptor, the larger will be the difference in the development potential between these areas for the subsequent development of image layers thereon.

Another issue that must be addressed with the image on image color image formation process is the residual charge and the resultant voltage drop that exists across the toner layer of a previously developed area of the photoreceptor. Although it may be possible to achieve voltage uniformity by recharging this previously toned layer to the same voltage level as neighboring bare areas, the associated residual toner voltage ($V_t$) prevents the effective voltage above any previously developed toned areas from being re-exposed and discharged to the same level as neighboring bare photoreceptor areas which have been exposed and discharged to the actual desired voltage levels. Furthermore, the residual voltage associated with previously developed toner images reduces the dielectric and effective development field in the toned areas, thereby hindering the attempt to achieve a desired uniform consistency of the developed mass of subsequent toner images. The problems become increasingly severe as additional color images are subsequently exposed and developed thereon. Color quality is severely threatened by the presence of the toner charge and the resultant voltage drop across the toner layer. The change in voltage due to the toned image can be responsible for color shifts, increased moire, increased color shift sensitivity to image misregistration and motion quality, toner spreading at image edges, and loss in latitude affecting many of the photoreceptor subsystems. Thus, it is ideal to reduce or eliminate the residual toner voltage of any previously developed toned images.

Prior attempts to address one or more of these issues have introduced a variety of secondary problems, each having an adverse effect on the image on image color image formation process. For example, the copending application for patent entitled "Method and Apparatus for Reducing Residual Toner Voltage", Ser. No. 08/347,616, by a common assignee as the present application, discloses a voltage sensitive recharge device used for the recharging steps during a color image formation, whose graph of the output current (I) to the charge retentive surface as a function of the voltage to the charge retentive surface (V) has a high (I/V) slope. The high I/V slope recharge device disclosed having an AC voltage supplied thereto, enables an extended time for neutralization to occur at the top of the toner layers. However, the amount of residual voltage $V_t$ reduction that can be realized is limited in this system.

Another recharging method is described in application for Japanese Patent No. Hei-03-202869, published Sep. 4, 1991 and Application No. Hei 1-340663, Application date Dec. 29, 1989, Publication date Sep. 4, 1991, assigned to Matsushita Denki Sangyo K.K. This reference discloses a color image forming apparatus wherein a first and second charging device are used to recharge a photoconductor carrying a first developed image, before exposure and development of a subsequent image thereon. The potential of the photoconductor is higher after passing the first charging device than after passing the second charging device. This reference teaches that the difference in voltage applied by the first and second charging devices to the toner image and photoreceptor surface is set to a relatively high level, to insure that the polarity of the toner image is reversed after passing and having been charged by both devices. The effect of this teaching is to reduce the residual charge in the image areas which becomes more severe when applying color toners onto previously developed color toners, and also to prevent toner spray (or toner spread) during the exposure process. Toner spray is a phenomena caused when the photoconductor carrying the first toner image is recharged to a relatively high charge level and then exposed for the second image development. In areas where the edges of a prior developed image align but do not overlap with the edges of a subsequent image, the toner of the prior image tends to spray or spread along its edges into the subsequently exposed areas which have a relatively lower charge level. By reversing the polarity of the toner as taught in this reference, toner spray is prevented, as the reversed polarity toner is no longer attracted to the exposed areas.

However, when a substantial amount of toner charge at the top of a previously developed toner layer is reversed in polarity during recharge, a different problem of a serious nature develops. Since the prior toner image is now predominantly of an opposite polarity to both the background bare areas and the incoming color toner to be developed thereon, an interaction occurs among these three separate and distinctly charged regions. For example, in a system having a negatively charged photoreceptor using discharged area development (DAD), the negatively charged toner used for development would be reversed in polarity after recharge using the teachings of Matsushita Japanese Patent No. Hei 1-340663. Particularly, the now-positively charged toner layer is then attracted to the negatively charged background areas and the negatively charged toner of the incoming color image. Thus, the positively charged toner of the first image tends to splatter into neighboring bare background regions. This occurrence has been titled the "under color splatter" defect (UCS) and is the cause for the unwanted blending of colors and the spreading of colors from image edges into background areas. The UCS defect is apparent both where the prior image aligns with a subsequent image, and also where the prior image overlaps with the subsequent image. Consequently, color clarity is severely impacted. Furthermore, when a relatively large voltage difference between the first and second charging devices is applied to the photoreceptor surface in order to reverse the polarity of the toner image, a significant amount of stress is applied to the photoreceptor, which may also negatively impact image quality, as well as reduce the life expectancy of the photoreceptor.

Based on the foregoing, a highly reliable and consistent manner of recharging the photoreceptor to a uniform level is needed, whereby the residual voltage on previously toned areas is minimized and the undercolor splatter defect is prevented. Furthermore, a recharging process is needed that does not impair image transfer and that does not unduly stress the photoreceptor. It would also be useful to have a single corona generating device perform two functions in order to reduce the size, weight and cost of a printer. This can be accomplished in a printing machine by having a charging or recharging corona device operate in a first mode for development and imaging purposes and in a second mode for transferring and cleaning purposes.

The following references may be found relevant to the present disclosure.

U.S. Pat. No. 4,791,452 relates to a two-color imaging apparatus wherein a first latent image is formed on a uniformly charged imaging surface and developed with toner particles. The charge retentive surface containing a first developed or toned image, and undeveloped or untoned background areas is then recharged by a scorotron charging device prior to optically exposing the surface to form a second latent electrostatic image thereon. An electrical potential sensor detects the surface potential level of the drum to ensure that a prescribed surface potential level is reached. The recharging step is intended to provide a uniformly charged imaging surface prior to effecting a second exposure.

U.S. Pat. No. 4,761,669 relates to creating two-color images. A first image is formed using the conventional xerographic process. Thus, a charge retentive surface is uniformly charged followed by light exposure to form a latent electrostatic image on the surface. The latent image is then developed. A corona generator device is utilized to erase the latent electrostatic image and increase the net charge of the first developed image to tack it to the surface electrostatically. This patent proposes the use of an erase lamp, if necessary, to help neutralize the first electrostatic image. A second electrostatic image is created using an ion projection device. The ion image is developed using a second developer of a different color.

U.S. Pat. No. 4,833,503 discloses a multi-color printer wherein a a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles. The charge pattern forming the developed image is neutralized prior to the formation of a second ion image by a corona generating unit and an erase lamp.

U.S. Pat. No. 5,241,356 discloses a multi-color printer wherein charged area images and discharged area images are created, the former being formed first, followed by an erase step and a recharge step before the latter is formed. An erase lamp is used during the erase step to reduce voltage non-uniformity between toned and untoned areas on a charge retentive surface.

U.S. Pat. No. 5,258,820 discloses a multi-color printer wherein charged area images and discharged area images are created. An erase lamp is used following development of a charged area (CAD), and a pre-recharge corona device is used following development of a discharged area (DAD) and prior to a recharge step, to reduce voltage non-uniformity between toned and untoned images on a charge retentive surface.

The copending application for U.S. patent titled "Method and Apparatus for Reducing Transferred Background Toner", Ser. No. 08/346,708 filed Nov. 30, 1994 by a common assignee as the present application, discloses a corona recharge device for recharging the photoreceptor containing at least one previously developed color image, to a voltage level intermediate to the background areas and the image areas. This intermediate recharge level keeps wrong-charge toner developed in the background areas at a charge level distinct from the toner developed in the image areas, so that the wrong-charge background toner does not transfer to a support substrate with the image.

Another copending application for U.S. patent titled "Split Recharge Method and Apparatus for Color Image Formation", Ser. No. 08/347,617 by a common assignee as the present application, discloses a multi-color imaging apparatus utilizing a recharge step between two image creation steps for recharging a charge retentive surface to a predetermined potential pursuant to forming the second of the two images, a first corona generating device recharges the charge retentive surface to a higher absolute potential than a predetermined potential, and then a second corona generating device recharges the charge retentive surface to the predetermined potential. An electrical charge associated with the first image is substantially neutralized after being recharged by the first and second corona generating device.

U.S. Pat. No. 4,141,648 and 4,432,631 teach a two cycle process electrophotographic copying machine having charging, imaging, developing, transferring, and cleaning facilities, whereas one of the corona devices performs both the final charge leveling and precleaning functions and another corona device performs both the precharging and transferring functions. During the first cycle of the two cycle process, the photoconductor is precharged to a first potential by the combined precharge/transfer corona and then the first potential is augmented to an overcharge by the combined final charge leveling/preclean corona device. Another corona device at the final charge/preclean station reduces and smoothes the overcharge of the photoconductor to the operating potential of the photoconductor and the imaging and developing then occur. In the second cycle, the toned image is transferred to the transfer media using the precharge/transfer corona. Following transfer, the drum is charged by the final charge/preclean corona to a second potential for cleaning.

U.S. Pat. No. 4,835,571 discloses a corona discharging unit which can perform more than one of the functions required in a copying process such as preliminary charging, transferring, discharging and cleaning. This is accomplished by having a shield case with a corona discharge line installed inside of it, a control grid in the vicinity of the open section of the shield case for controlling the polarity and/or output of the corona discharge, a controller connected to the grid for controlling the polarity and/or output of the corona discharge, and a high voltage AC power source connected to the corona discharge line. The corona device has a positive or negative polarity and an AC or DC power source depending upon its desired function in the copying cycle. Various control devices are disclosed.

A number of commercial printers employ the REaD charge/expose/develop/recharge imaging process. For example, the Konica 9028, a multi-pass color printer forms a single color image for each pass. Each such pass utilizes a recharge step following development of each color image. The Panasonic FPC1 machine, like the Konica machine is a multi-pass color device. In addition to a recharge step the FPC1 machine employs an AC corona discharge device prior to recharge.

SUMMARY OF THE INVENTION

In accordance with one aspect of the invention, a method for creating multiple images in a printing machine is disclosed. A charge retentive surface is passed through at least two passes; the charge retentive surface being charged and a latent image being recorded and developed thereon; the charge retentive surface is charged, imaged, and developed another time with a first corona generating device having a first and second purpose in different passes of the charge retentive surface.

Another aspect of the invention includes a method for creating multiple images in a printing machine using a corona generating device for a charging purpose in one pass of a charge retentive surface and as a pre-transfer corona generating device in another pass of the charge retentive surface.

A third aspect of the invention is a printing machine for creating multiple images with a charge retentive surface being passed through at least two passes of the printing machine. In each pass, the charge retentive surface is charged, recorded and developed with controlling means to control a first corona generating device. The controlling means controls the corona device for a first purpose in one pass and another purpose in another pass.

In order to produce a more efficient and cost effective printing machine, at least one corona device is used for two different purposes in a multiple image printing cycle. A printing machine having fewer corona devices is less costly and requires less space than a conventional printing machine. Space and cost considerations are of particular importance to small, low-end printers.

DETAILED DESCRIPTION OF THE PREFERRED EMBODIMENT OF THE INVENTION

This invention relates to an imaging system which is used to produce an image on image color output in which corona generating devices perform two functions. It will be understood, however, that it is not intended to limit the invention to the embodiments disclosed. On the contrary, it is intended to cover all alternatives, modifications and equivalents as may be included within the spirit and scope of the invention as defined by the appended claims.

Figure 1:
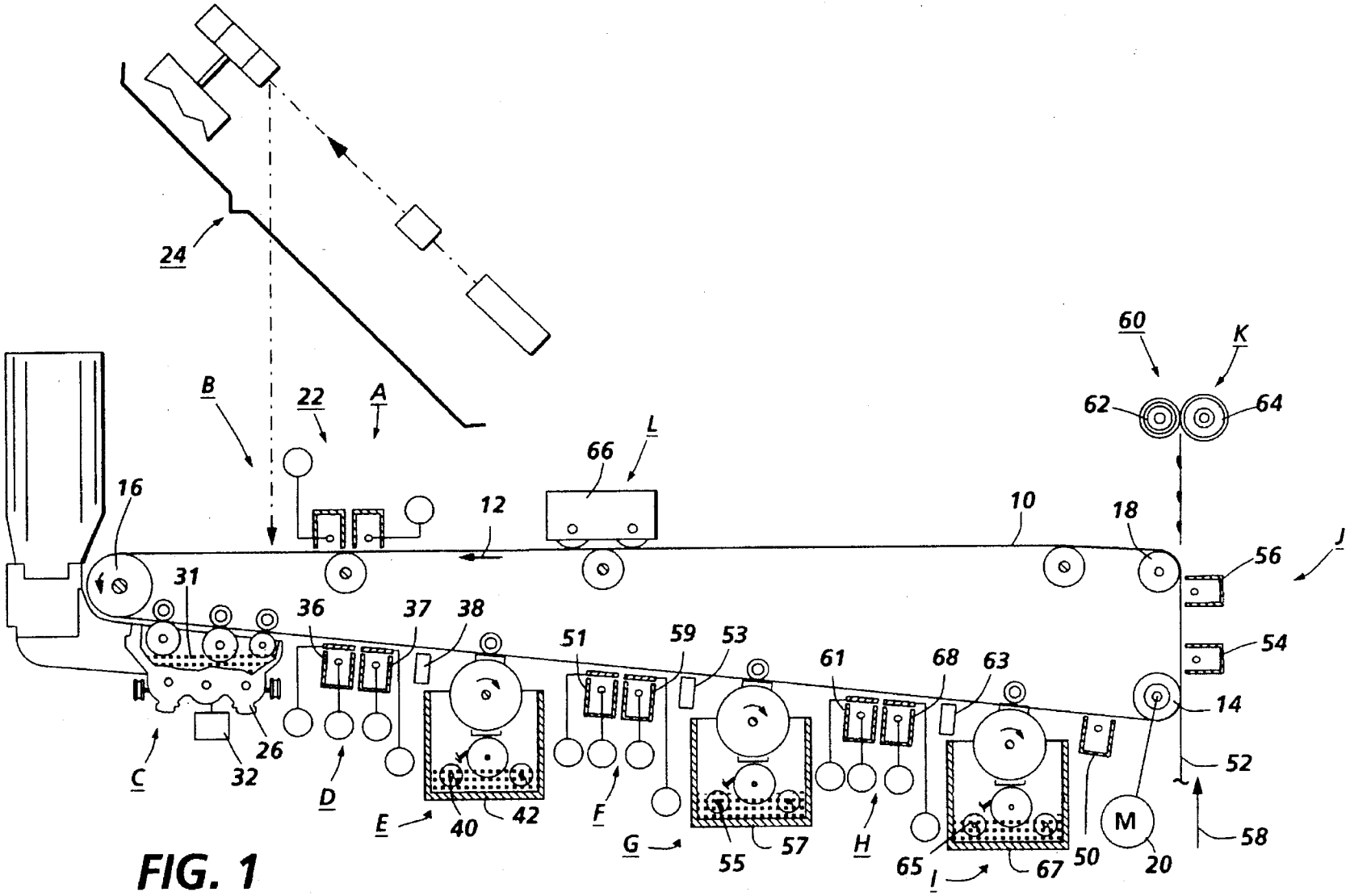
FIG. 1 is a schematic illustration of an example single pass imaging apparatus.

Turning now to FIG. 1, the electrophotographic printing machine of the copending patent application U.S. Ser. No. 08/347,617 which uses a charge retentive surface in the form of an Active Matrix (AMAT) photoreceptor belt 10 supported for movement in the direction indicated by arrow 12, for advancing sequentially through the various xeorographic stations. Belt 10 is supported by rollers 14, 16 and 18. A motor 20 drives roller 14 which which in turn causes the belt to move.

With continued reference to FIG. 1, a portion of belt 10 passes through charging station A where a corona generating device, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of photoconductive surface is advanced through an imaging and exposure station B. At imaging and exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices known in the art.

The photoreceptor, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a monopolar voltage profile of high and low voltages, the former corresponding to charged areas and the latter corresponding to discharged or image areas.

At a first development station C, a magnetic brush developer structure, indicated generally by the reference numeral 26 advances insulative magnetic brush (IMB) material 31 into contact with the electrostatic latent image. The development structure 26 comprises a plurality of magnetic brush roller members. These magnetic brush rollers present, for example, negatively charged black toner material to the image areas for development thereof. Appropriate developer biasing is accomplished via power supply 32. Electrical biasing is such as to effect discharged area development (DAD) of the lower (less negative) of the two voltage levels on the photoreceptor with the material 31.

At recharging station D, a pair of corona recharge devices 36 and 37 are employed for adjusting the voltage level of both the toned and untoned areas on the photoreceptor surface to a substantially uniform level. A power supply coupled to each of the electrodes of corona recharge devices 36 and 37 and to any grid or other voltage control surface associated therewith, serves as a voltage source to the devices. The recharging devices 36 and 37 serve to substantially eliminate any voltage difference between toned areas and bare untoned areas, as well as to reduce the level of residual charge remaining on the previously toned areas, so that subsequent development of different color toner images is effected across a uniform development field. The first corona recharge device 36 overcharges the photoreceptor surface 10 containing previously toned and untoned areas, to a level higher than the voltage level ultimately required for $V_{ddp}$, for example to −700 volts. The predominant corona charge delivered from corona recharge device 36 is negative. The second corona recharge device 37 reduces the photoreceptor surface 10 voltage to the desired $V_{ddp}$, −500 volts. Hence, the predominant corona charge delivered from the second corona recharge device 37 is positive. Thus, a voltage split of 200 volts is applied to the photoreceptor surface. The voltage split ($V_{split}$) is defined as the difference in photoreceptor surface potential after being recharged by the first corona recharge device and the second corona recharge device, e.g. $V_{split}$=−700 volts−−500 volts=−200 volts. The surface 10 potential after having passed each of the two corona recharge devices, as well as the amount of voltage split of the photoreceptor, are preselected to otherwise prevent the electrical charge associated with the developed image from substantially reversing in polarity, so that the occurrence of under color splatter (UCS) is avoided. Further, the corona recharge device types and the voltage split are selected to ensure that the charge at the top of the toner layer is substantially neutralized rather than driven to the reverse polarity (e.g. from negative to become substantially positive).

A second exposure or imaging device 38 which may comprise a laser based output structure is utilized for selectively discharging the photoreceptor on toned areas and/or bare areas to approximately −50 volts, pursuant to the image to be developed with the second color developer. After this point, the photoreceptor contains toned and untoned areas at relatively high voltage levels (e.g. −500 volts) and toned and untoned areas at relatively low voltage levels (e.g. −50 volts). These low voltage areas represent image areas which are to be developed using discharged area development. To this end, a negatively charged developer material 40 comprising, for example, yellow color toner is employed. The toner is contained in a developer housing structure 42 disposed at a second developer station E and is presented to the latent images on the photoreceptor by a non-interactive developer. A power supply (not shown) serves to electrically bias the developer structure to a level effective to develop the DAD image areas with the negatively charged yellow toner particles 40.

At a second recharging station F, a pair of corona recharge devices 51 and 59 are employed for adjusting the voltage level of both the toned and untoned areas on the photoreceptor to a substantially uniform level. A power supply coupled to each of the electrodes of corona recharge devices 51 and 59 and to any grid or other voltage control surface associated therewith, serves as a voltage source to the devices. The recharging devices 51 and 59 serve to substantially eliminate any voltage difference between toned areas and bare untoned areas, as well as to reduce the level of residual charge remaining on the previously toned areas so that subsequent development of different color toner images is effected across a uniform development field. The first corona recharge device 51 overcharges the photoreceptor surface containing previously toned and untoned areas, to a level higher than the voltage level ultimately required for $V_{ddp}$, for example to −700 volts. The predominant corona charge delivered from corona recharge device 51 is negative. The second corona recharge device 59 reduces the photoreceptor voltage to the desired $V_{ddp}$, −500 volts. Hence, the predominant corona charge delivered from the second corona recharge device 59 is positive. The surface potential after having passed each of the two corona recharge devices, as well as the amount of voltage split, are preselected to otherwise prevent the electrical charge associated with the developed image from substantially reversing in polarity, so that the occurrence of UCS is avoided. Further, the corona recharge device types and the voltage split are selected to ensure that the charge at the top of the toner layer is substantially neutralized rather than driven to the reverse polarity.

A third latent image is created using an imaging or exposure member 53. In this instance, a third DAD image is formed, discharging to approximately −50 volts those bare areas and toned areas of the photoreceptor that will be developed with the third color image. This image is developed using a third color toner 55 contained in a non-interactive developer housing 57 disposed at a third developer station G. An example of a suitable third color toner is magenta. Suitable electrical biasing of the housing 57 is provided by a power supply, not shown.

At a third recharging station H, a pair of corona recharge devices 61 and 69 are employed for adjusting the voltage level of both the toned and untoned areas on the photoreceptor to a substantially uniform level. A power supply coupled to each of the electrodes of corona recharge devices 61 and 69 and to any grid or other voltage control surface associated therewith, serves as a voltage source to the devices. The recharging devices 61 and 69 serve to substantially eliminate any voltage difference between toned areas and bare untoned areas as well as to reduce the level of residual charge remaining on the previously toned areas, so that subsequent development of different color toner images is effected across a uniform development field. The first corona recharge device 61 overcharges the photoreceptor surface containing previously toned and untoned areas, to a level higher than the voltage level ultimately required for $V_{ddp}$, for example to −700 volts. The predominant corona charge delivered from corona recharge device 61 is negative. The second corona recharge device 69 reduces the photoreceptor voltage to the desired $V_{ddp}$, −500 volts. Hence, the predominant corona charge delivered from the second corona recharge device 69 is positive. The surface potential after having passed each of the two corona recharge devices, as well as the amount of voltage split, are preselected to otherwise prevent the electrical charge associated with the developed image from substantially reversing in polarity, so that the occurrence of UCS is avoided. Further, the corona recharge device types and the voltage split are selected to ensure that the charge at the top of the toner layer is substantially neutralized rather than driven to the reverse polarity.

A fourth latent image is created using an imaging or exposure member 63. A fourth DAD image is formed on both bare areas and previously toned areas of the photoreceptor that are to be developed with the fourth color image. This image is developed, for example, using a cyan color toner 65 contained in developer housing 67 at a fourth developer station I. Suitable electrical biasing of the housing 67 is provided by a power supply, not shown. In a single pass system as shown in FIG. 1, an advantage of developing the color toners in the order hereinbefore described, i.e. black first, is the elimination of the need for one of the two corona recharge devices during the first recharge step, since subsequent color images are typically not developed over the image areas developed with black color toner. Thus, the recharge issues normally present when developing over other color toners is not present during recharge of a photoreceptor surface having a black-first toner image, obviating the need for the advantages presented by the split recharge concept of the present invention during this first recharge step.

The developer housing structures 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image on image color development system. A non-interactive, scavengeless development housing having minimal interactive effects between previously deposited toner and subsequently presented toner is described in U.S. Pat. No. 4,833,503, the relevant portions of which are hereby incorporated by reference herein.

In order to condition the toner for effective transfer to a substrate, a negative pre-transfer corotron member 50 delivers negative corona to ensure that all toner particles are of the required negative polarity to ensure proper subsequent transfer. Another manner of ensuring the proper charge associated with the toner image to be transferred is described in U.S. Pat. No. 5,351,113, the relevant portions of which are hereby incorporated by reference herein.

Subsequent to image development a sheet of support material 52 is moved into contact with the toner images at transfer station J. The sheet of support material is advanced to transfer station J by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer corona device 54 which sprays positive ions onto the backside of sheet 52. This attracts the negatively charged toner powder images from the belt 10 to sheet 52. A detack corona device 56 is provided for facilitating stripping of the sheets from the belt 10.

After transfer, the sheet continues to move, in the direction of arrow 58, onto a conveyor (not shown) which advances the sheet to fusing station K. Fusing station K includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L using a cleaning brush structure contained in a housing 66.

The various machine functions described hereinabove are generally managed and regulated by a controller (not shown), preferably in the form of a programmable microprocessor. The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The recharge devices 36, 37, 51, 59, 61 and 69 have been described generally as corona generating devices, with reference to FIG. 1. However, it is understood that the corona generating devices for use in the present invention could be in the form of, for example, a corotron, scorotron, dicorotron, pin scorotron, or other corona charging devices known in the art. In the present example having a negatively charged photoreceptor, the negatively charged toner is recharged by a first corona recharge device of which the predominant corona charge delivered is negative. Thus, either a negative DC corona generating device, or an AC corona generating device biased to deliver negative current would be appropriate for such purpose. The second corona recharge device is required to deliver a predominantly positive charge to accomplish the objectives of the present invention, and therefore a positive DC or an AC corona generating device would be appropriate.

A high slope, voltage sensitive DC device is used for the first corona recharge device, and a high slope, voltage sensitive AC device is used for the second corona recharge device. This configuration accomplishes the stated objectives of achieving voltage uniformity between previously toned areas and untoned areas of the photoreceptor so that subsequent exposure and development steps are effected across a uniformly charged surface; as well as reducing the residual charge of the previously developed areas so that subsequent development steps are effected across a uniform development field. Further, these objectives are successfully attained while ensuring that toner charge at the top of the toner layer is substantially neutralized rather than driven to reverse its polarity, so that UCS occurrence is avoided.

Figure 2:
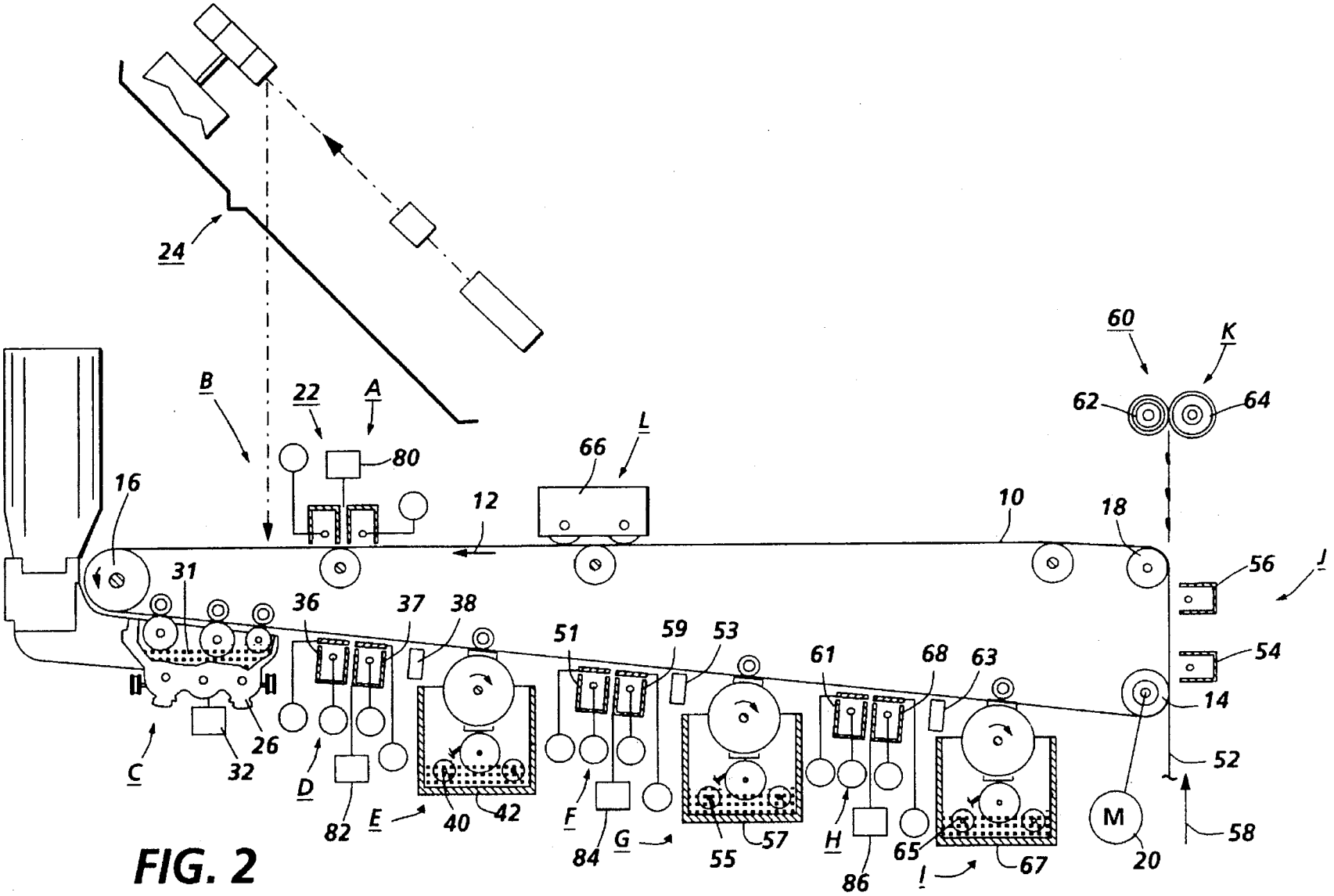
FIG. 2 is a schematic illustration of a single pass imaging apparatus incorporating the dual-use corona concept.

FIG. 2 is the same as FIG. 1 except that controllers 80, 82, 84 and 86 have been added to charging stations A, D, F and H. and the pretransfer corona device has been removed. In this preferred embodiment, charging stations A, D, F and H are capable of performing two charging functions; one as described for FIG. 1 and a second function in another pass for FIG. 2.

Rather than have the the pretransfer operation begin at the end of the first pass as in FIG. 1, the photoreceptor makes a second pass through the printing machine stations. In the second pass there is no imaging and the charging stations do not charge the photoreceptor for development purposes. Instead, one of the charging stations, A, D, F, or H operates as a pretransfer corona device in the second pass of the photoreceptor. There are many ways associated with the copying cycle to control the corona devices. Tagawa et al. (U.S. Pat. No. 4,835,571) disclosed above and incorporated herein by reference, teaches several methods of controlling corona devices in a copying machine. Having at least one of the corona generating devices perform more than one purpose results in a lesser number of necessary corona generating devices.

Transfer (54) and detack (56) corona devices at transfer station J could also have controllers associated with them so that these corona devices could replace charging station A. This would be accomplished by having the transfer corona device 54 perform the first charging function of station A and detack corona device 56 perform the second charging function of station A in the first pass and performing the transfer and detack functions in the second pass.

Figure 3:
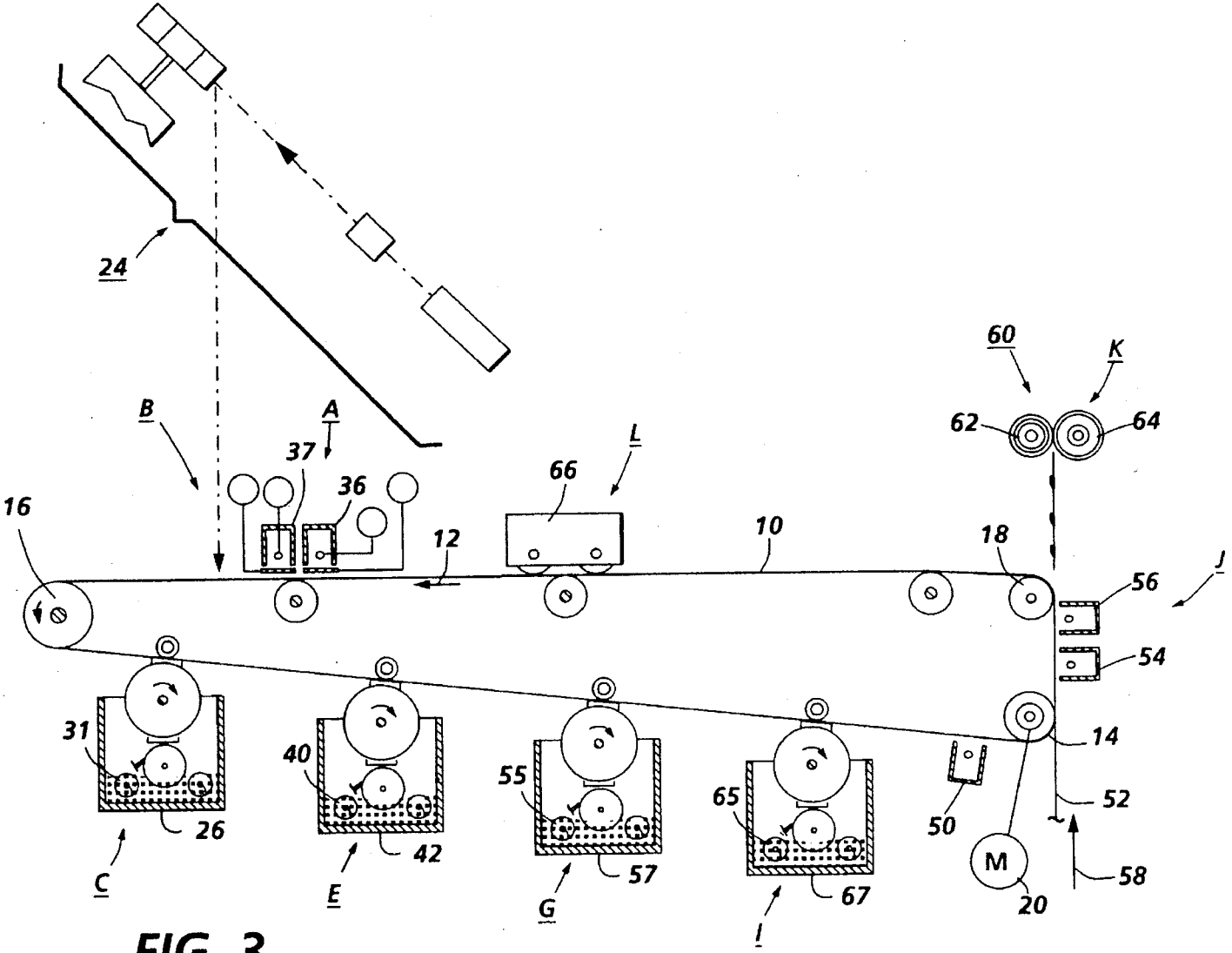
FIG. 3 is a schematic illustration of an example multipass imaging apparatus.

FIG. 3 illustrates another example of an electrostatographic printing apparatus which would find advantageous use of the present invention. FIG. 2 represents a multiple pass color image formation process, where each successive color image is applied in a subsequent pass or rotation of the photoreceptor. Like reference numerals to those in FIG. 1 correspond with identical elements to those represented in FIG. 3, with the exception that a non-interactive development system at Development Station C replaces the magnetic brush development system used as an example in FIG. 1, for purposes of illustration of alternate and equivalent embodiments for use with the present invention. Furthermore, in a multi-pass system as represented in FIG. 3, only a single set of recharging devices 36 and 37, indicated generally at charging/recharging station A, is needed to recharge the photoreceptor surface 10 prior to each subsequent color image formation. For purposes of simplicity, both recharging devices 36 and 37 can be employed for initially charging the photoreceptor using the split recharge concept of the present invention as hereinbefore described, prior to the exposure of the first color toner latent image. However, it is understood that a controller (not shown) could be used to regulate the charging step so that only a single recharge device is used to charge the photoreceptor surface to the desired voltage level for exposure and development thereon. Also, only a single exposure device 24 is needed to expose the photoreceptor prior to each color image development. In a multipass system as illustrated in FIG. 3, it is understood that the cleaning station L is of the type that is capable of camming away from the surface of the photoreceptor during the image formation process, so that the image is not disturbed prior to image transfer.

Figure 4:
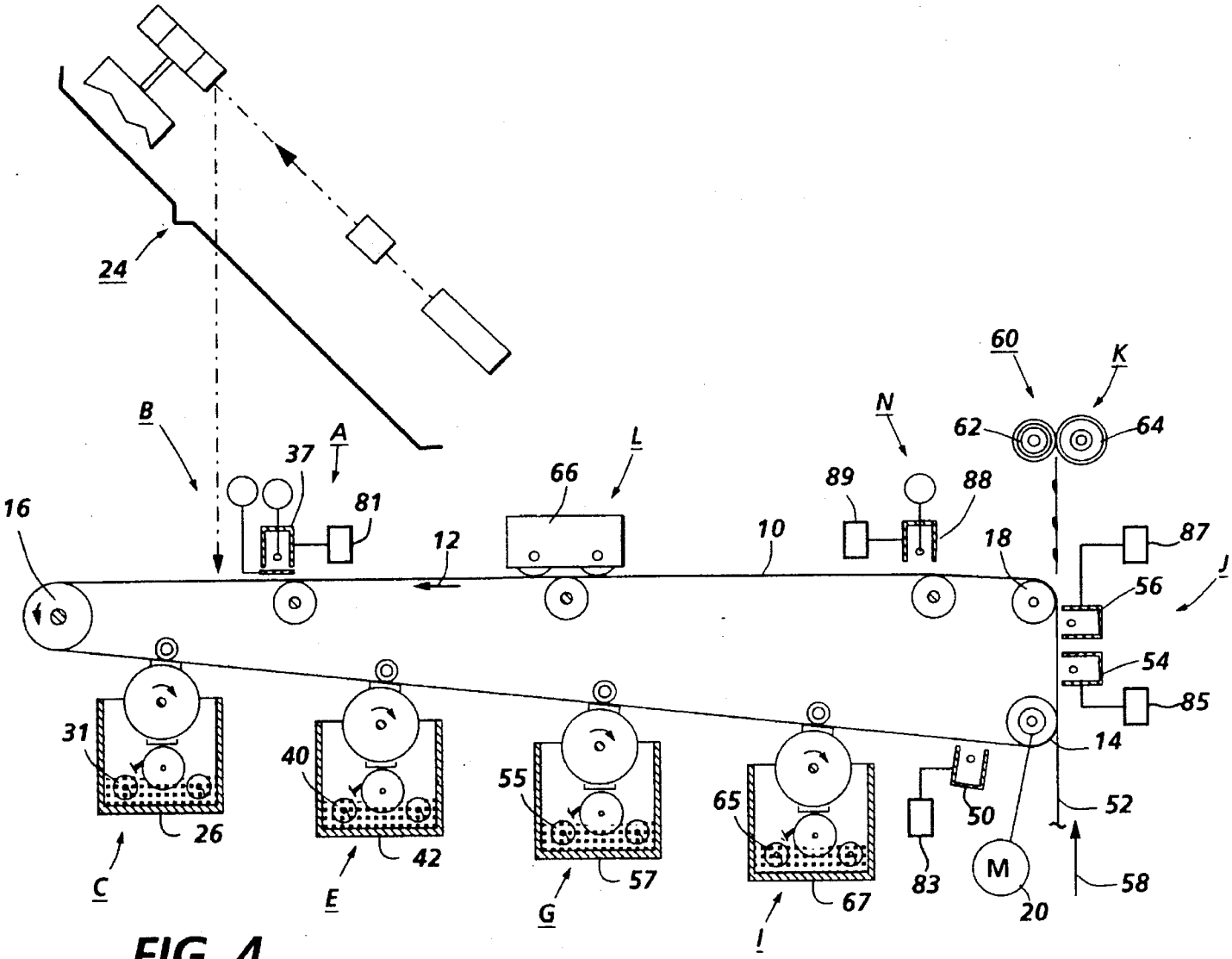
FIG. 4 is a schematic illustration of a multipass imaging apparatus incorporating the dual-use concept.

FIG. 4 is similar to FIG. 3 except that a pre-cleaning station N has been added; recharging corona device 36 has been removed; and controllers 81, 83, 85, 87 and 89 have been added to the remaining corona devices. Precleaner 88 has been added to the configuration so that the residual particles on the imaging surface are discharged prior to cleaning station L for more effective cleaning of the photoreceptor. The controllers 83, 85, 87 and 89 have been added so that at least one of the pre-transfer, transfer, detack or preclean corona devices can perform two functions depending on the multi-pass cycle requirements. Only one additional controller attached to the corona device performing the dual function is necessary for this embodiment. The additional controllers 85, 87 and 89 are shown for illustrative purposes for other embodiments.

The following is an example operation of the multi-pass color image formation process which uses Split Recharge with the pre-transfer device being used as the dual function corona device. As explained above, any of the transfer, detack or preclean devices could be used as the dual function corona device.

During the first cycle, recharging device 37 initially charges the photoreceptor to $V_0$ for the desired $V_{ddp}$, the photoreceptor is exposed and the image is developed. There is no Split Recharge used for imaging in the first cycle. After the first image is developed, the recharge/pre-transfer corona device 50 acts as the first recharging device and applies the correct charge to the photoreceptor and toner image. This function was previously done by recharging corona device 36 in FIG. 3. The charge applied by the recharge/pre-transfer corona device 50 is the first overcharge value which equals $V_{ddp}$ plus the intended split differential voltage. In the usual multipass system, the pre-transfer corona device is deactivated in this cycle.

For the second cycle, recharging device 37 charges the photoreceptor and the applied toner to the desired $V_{ddp}$ for imaging; acting as the second corona of the split charge operation. The second image is developed, and the photoreceptor passes the recharge/pretransfer device 50, which again charges the photoreceptor and toner to the desired over charge value.

This process is repeated for the third and fourth cycles until the image is developed on the fourth cycle. After the image has been developed on the fourth cycle, the recharge/pre-transfer device 50 is controlled by controller 83 to apply the correct pre-transfer charge, rather than the overcharge charge. For the rest of the fourth cycle, the transfer, detack and pre-clean corona devices are activated.

Depending upon the corona device used, the appropriate controller is chosen. Controllers are associated with the corona devices; controller 81 with recharging corona device 37, controller 83 with pretransfer corona device 50, controller 85 with transfer corona device 54, controller 87 with detack corona device 57.and controller 89 with pre-clean corona device 88. As explained above, only one of controllers 81, 83, 85, 87 or 89 is necessarily associated with one of the corona devices. There are many ways associated with the copying cycle to control the corona devices, Tagawa et al. (U.S. Pat. No. 4,835,571) disclosed above, teaching several methods of controlling corona devices in a copying machine. A controller 81 has been added to the precharge corona device 37 so that its voltage may also be varied as explained below.

For most applications $V_{ddp}$ will vary with each cycle, depending upon charges required for proper toner application and development. For example, values for $V_{ddp}$ are −350 V for the first image to be developed with black toner, −350 V for the second image to be developed with yellow toner, −400 V for the third image to be developed with magenta toner and −450 V for the fourth image to be developed with the cyan toner. The first and second recharging devices are controlled so that the desirable Vsplit voltage of approximately 200 V is maintained for each cycle.

Figure 5:
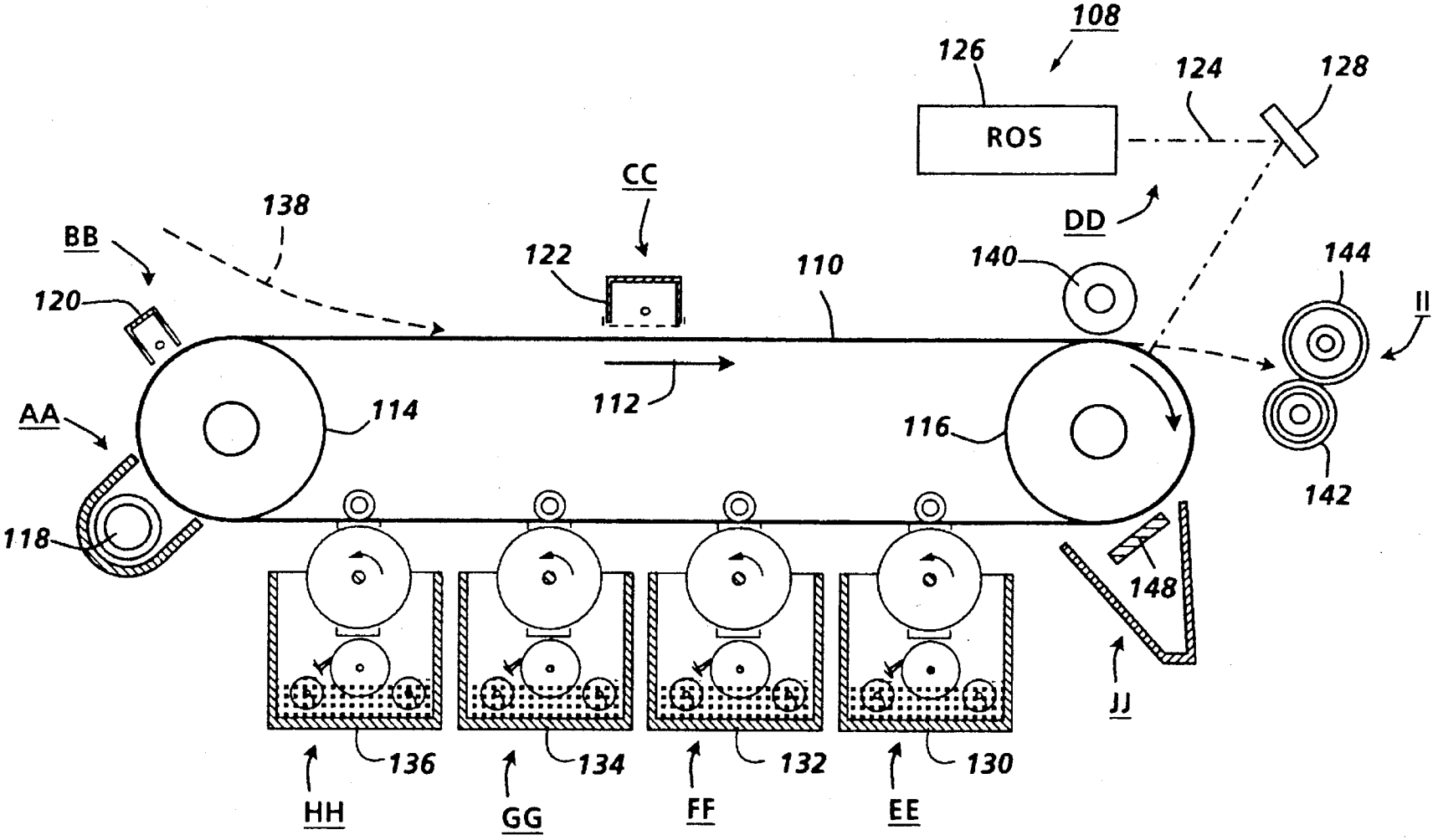
FIG. 5 is a schematic illustration of another multipass imaging apparatus incorporating the dual-use corona concept.

The embodiment shown in FIG. 5 includes a plurality of individual subsystems which are well known in the prior art but which are organized and used so as to produce a color image in 5 cycles, or passes, of a photoconductive member. While the 5 cycle color electrophotographic architecture results in a 20% loss of productivity over a comparable 4 cycle color electrophotographic architecture, the additional cycle allows for a significant size and cost reduction.

FIG. 5 illustrates a color electrophotographic printing machine 108 which is suitable for implementing the principles of the present invention in a 5 cycle multipass printing machine. The printing machine 108 includes an Active Matrix (AMAT) photoreceptor belt 110 which travels in the direction indicated by the arrow 112. Belt travel is brought about by mounting the belt about a drive roller 116 (which is driven by a motor which is not shown) and a tension roller 114.

As the photoreceptor belt travels, each part of it passes through each of the subsequently described process stations. For convenience, a single section of the photoreceptor belt, referred to as the image area, is identified. The image area is that part of the photoreceptor belt which is to receive the toner images which, after being transferred to a substrate, produce the final color image. While the photoreceptor belt may have numerous image areas, since each image area is processed in the same way a description of the processing of one image area suffices to fully explain the operation of the printing machine.

As previously mentioned, the production of a complete color print takes place in 5 cycles. The first cycle begins with the image area passing through an erase station AA. At the erase station an erase lamp 118 illuminates the image area so as to cause any residual charge which exists on the image area to be discharged.

As the photoreceptor belt continues its travel, the image area passes through a first charging station BB. At the first charging station BB a corona generating device 120, beneficially a DC pin scorotron, charges the image area to a relatively high and substantially uniform potential of, for example, about −700 volts. After passing the corona generating device 120 the image area passes through a second charging station CC which partially discharges the image area to about, for example −500 volts. The second charging station CC includes an AC scorotron 122.

Since split charging is beneficial for recharging a photoreceptor which already has a developed toner layer, and since the image area does not have such a toner layer during the first cycle, split charging is not required during the first cycle. If split charging is not used either the corona generating device 120 or the scorotron 122 corona could be used to simply charge the image area to the desired level of −500 volts. Split charging is described in more detail below.

After passing through the second charging station CC the now charged image area passes through an exposure station DD. At the exposure station DD the charged image area is exposed to the output 124 of a laser based output scanning device 126 and which reflects from a mirror 128. During the first cycle the output 124 illuminates the image area with a light representation of a first color (say black) image. That light representation discharges some parts of the image area so as to create an electrostatic latent image. For example, illuminated sections of the image area might be discharged by the output 124 to about −50 volts. Thus after exposure the image area has a voltage profile comprised of relatively high voltages of about −500 volts and of relatively low voltages of about −50 volts.

After passing through the exposure station DD the exposed image area passes through a first development station EE which deposits a first color of negatively charged toner 130, preferably black, onto the image area. Toner adhering to the image area is charged negatively. After development, the toned parts of the image area are charged to about −200 volts while the untoned parts are charged to about −500 volts.

While the first development station could be a magnetic brush developer, it is preferably a scavengeless developer. Scavengeless development is well known and is described in U.S. Pat. No. 4,984,019 entitled, "Electrode Wire Cleaning," issued 3 Jan. 1991 to Folkins; in U.S. Pat. No. 4,868,600 entitled "Scavengeless Development Apparatus for Use in Highlight Color Imaging," issued 19 Sep. 1989 to Hayes et al.; in U.S. Pat. No. 5,010,367 entitled "Dual AC Development System for Controlling The Spacing of a Toner Cloud," issued 23 Apr. 1991 to Hays; in U.S. Pat. No. 5,253,016 entitled, "Contaminant Control for Scavengeless Development in a Xerographic Apparatus," issued on 12 Oct. 1993 to Behe et al.; and in U.S. Pat. No. 5,341,197 entitled, "Proper Charging of Doner Roll in Hybrid Development," issued to Folkins et al. on 23 Aug. 1994. Those patents are hereby incorporated by reference.

One benefit of scavengeless development is that it does not disturb previously deposited toner layers. Since during the first cycle the image area does not have a previously developed toner layer, the use of scavengeless development is not absolutely required as long as the developer is physically cammed away during other cycles. However, since the other development station (described below) use scavengeless development it may be better to use scavengeless development at each development station.

After passing through the first development station EE, the image area advances so as to return to the first charging station BB. The second cycle begins. The first charging station BB uses its corona generating device 120 to overcharge the image area and its first toner layer to more negative voltage levels than that which the image area and its first toner layer are to have when they are exposed. For example, the untoned parts of the image area may be charged to a potential of about −700 volts.

The voltage differences between the toned and untoned parts of the image area are substantially reduced at the second charging station CC. There the AC scorotron 122 reduces the negative charge on the image area by applying positive ions so as to charge the image area to about −500 volts.

An advantage of using an AC scorotron at the second charging station is that it has a high operating slope: a small voltage variation on the image area can result in large charging currents being applied to the image area. Beneficially, the voltage applied to the metallic grid of the AC scorotron 122 can be used to control the voltage at which charging currents are supplied to the image area. A disadvantage of using an AC scorotron is that it, like other AC operated charging devices, tends to generate much more ozone than comparable DC operated charging devices.

After passing through the second charging station CC the now substantially uniformly charged image area with its first toner layer advances to the exposure station DD. At the exposure station DD the recharged image area is again exposed to the output 124 of a laser based output scanning device 126. During this pass the scanning device 126 illuminates the image area with a light representation of a second color (say yellow) image. That light representation discharges some parts of the image area so as to create a second electrostatic latent image. The potentials on the image area after it passes through the exposure station DD the second time have a potential about −500. However, the illuminated areas, both the previously toned areas and the untoned areas are discharged to about −50 volts.

After passing through the exposure station DD the now exposed image area passes through a second development station FF which deposits a second color of toner 132, yellow, onto the image area. The second development station FF preferably is a scavengeless developer.

After passing through the second development station FF the image area and its two toner layers returns to the first charging station BB. The third cycle begins. The first charging station BB again uses its corona generating device 120 to overcharge the image area and its two toner layers to more negative voltage levels than that which the image area and its two toner layer are to have when they are exposed. The second charging station CC again reduces the image area potentials to about −500 volts. The substantially uniformly charged image area with its two toner layers then advances again to the exposure station DD. At exposure station DD the image area is again exposed to the output 124 of the laser based output scanning device 126. During this pass the scanning device 126 illuminates the image area with a light representation of a third color (say magenta) image. That light representation discharges some parts of the image area so as to create a third electrostatic latent image.

After passing through the exposure station DD the third time the image area passes through a third development station GG. The third development station GG, preferably a scavengeless developer, advances a third color of toner 134, magenta, onto the image area. The result is a third toner layer on the image area.

The image area with its three toner layers then advances back to the charging station BB. The fourth cycle begins. The first charging station BB once again uses its corona generating device 120 to overcharge the image area (and its three toner layers) to more negative voltage levels than that which the image area is to have when it is exposed (say about −500 volts). The second charging station CC once again reduces the image area potentials to about −500 volts. The substantially uniformly charged image area with its three toner layers then advances yet again to the exposure station DD. At the exposure station DD the recharged image area is again exposed to the output 124 of the laser based output scanning device 126. During this pass the scanning device 126 illuminates the image area with a light representation of a fourth color (say cyan) image. That light representation discharges some parts of the image area so as to create a fourth electrostatic latent image.

After passing through the exposure station DD the fourth time the image area passes through a fourth development station HH. The fourth development station, also a scavengeless developer, advances a fourth color of toner 136, cyan, onto the image area. This marks the end of the fourth cycle.

After completing the fourth cycle the image area has four toner powder images which make up a composite color powder image. The fifth cycle begins with the image area passing the erase station AA. At erase station AA the erase lamp 118 discharges the image area to a relatively low voltage level. The image area with its composite color powder image then passes to the charging station BB. During the fifth cycle the charging station BB acts like a pre-transfer charging device by spraying the image area with negative ions. As the image area continues in its travel a substrate 138 is advanced into place over the image area using a sheet feeder (which is not shown). As the image area and substrate continue their travel they pass through the station CC.

At station CC positive ions are applied by the scorotron 122 onto one side of the substrate 138. This attracts the charged toner particles from the image area onto the substrate. As the substrate continues its travel the substrate passes a bias transfer roll 140 which assists in separating the substrate and the composite color powder image from the photoreceptor belt 110. The substrate is then directed into a fuser station II where a heated fuser roll 142 and a heated pressure roller 144 create a nip through which the substrate passes. The combination of pressure and heat at the nip causes the composite color toner image to fuse into the substrate 138. After fusing a chute, not shown, guides the support sheets 138 to a catch tray, also not shown, for removal by an operator.

After the substrate is pulled off the photoreceptor belt 110 by the bias transfer roll 140 the image area continues its travel and eventually enters a cleaning station JJ. At cleaning station JJ a cleaning blade 148 is brought into contact with the image area. The cleaning blade wipes residual toner particles from the image area. The image area then passes once again to the erase station A and the 5 cycle printing process begins again.

The various machine functions described above are generally managed and regulated by a controller which provides electrical command signals for controlling the operations described above.

While the foregoing description was directed to a $DAD^n$ image on image process color printer where a full color image is built successively on the charge retentive surface, it will be appreciated that the invention may also be used in a charged area development $CAD^n$ or $CAD\text{-}DAD^n$.

It is, therefore, apparent that there has been provided in accordance with the present invention, a method and apparatus for creating multiple images in which a corona generating device serves two purposes that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed:

1. A method for creating multiple images in a printing machine comprising:

passing a charge retentive surface through at least two passes;

charging the charge retentive surface;

recording a first latent image on the charge retentive surface;

developing the first latent image on the charge retentive surface;

predetermining a surface potential for recharging the charge retentive surface and the developed image thereto;

recharging the charge retentive surface with a first corona generating device having a first purpose to a higher absolute potential than the predetermined potential;

subsequently recharging the charge retentive surface and the developed image with a second corona generating device to the predetermined potential;

recording another latent image on the charge retentive surface;

developing the another latent image on the charge retentive surface; and charging the charge retentive surface with the first corona generating device having a second purpose in the last pass of the charge retentive surface.

2. The method for creating multiple images as claimed in claim 1, further comprising:

charging the charge retentive surface, the developed latent image and the another developed latent image with the first corona generating device having the first purpose;

recording a third latent image on the charge retentive surface;

developing the third latent image on the charge retentive surface;

charging the charge retentive surface, the developed latent image, the another developed latent image and the third developed latent image with the first corona generating device having the first purpose;

recording a fourth latent image on the charge retentive surface; and developing the fourth latent image on the charge retentive surface.

3. The method for creating multiple images as claimed in claim 1, wherein said recharging step and said subsequent recharging step are performed in two different passes.

4. The method for creating multiple images as claimed in claim 3, wherein said passing step includes four passes.

5. The method for creating multiple images as claimed in claim 1, wherein said recharging step and said subsequent recharging step are performed in the same pass.

6. The method for creating multiple images as claimed in claim 5, wherein said passing step includes five passes.

7. A method for creating multiple images as claimed in claim 1, wherein the second purpose of the first corona generating device is precleaning treatment.

8. A printing machine comprising:

a charge retentive surface which makes at least two passes through the printing machine to form an image, a pass being one revolution of the charge retentive surface;

a first corona generating device having a charging device use in one pass and a pre-transfer device use in another pass.

9. The printing machine as claimed in claim 8, further comprising:

the charge retentive surface having a developed image thereon, the developed image having an electrical charge associated therewith;

a corona generating apparatus for recharging said charge retentive surface and the developed image to a predetermined potential, said corona generating recharge device including:

said first corona generating device, wherein the charging device use is recharging said charge retentive surface and the developed image to a higher absolute potential than the predetermined potential; and a second corona generating device for recharging said charge retentive surface and the developed image to the predetermined potential.

10. A printing machine comprising:

a charge retentive surface which makes at least two passes through the printing machine to form an image, a pass being one revolution of the charge retentive surface; and a first corona generating device having a charging device use in a first pass and a detack device use in a second pass.

11. A method for creating multiple images in a printing machine comprising:

passing a charge retentive surface through at least two passes;

charging the charge retentive surface;

recording a latent image on the charge retentive surface;

developing the latent image on the charge retentive surface;

charging the charge retentive surface and the developed latent image with a first corona generating device having a first purpose;

recording another latent image on the charge retentive surface;

developing the another latent image on the charge retentive surface; and charging the charge retentive surface with the first corona generating device having a second purpose in the last pass, wherein the last pass includes a developing step.

12. A method for creating multiple images as claimed in claim 11, wherein the second purpose is for post-development purposes.

13. A method for creating multiple images as claimed in claim 11, wherein the second purpose is for transferring.

14. A method for creating multiple images as claimed in claim 11, wherein the second purpose is for detacking.

15. A method for creating multiple images as claimed in claim 11, wherein the second purpose is for precleaning.

16. A method for creating multiple images as claimed in claim 11, wherein the second purpose is for pretransfer treatment.

17. A method for creating multiple images as claimed in claim 11, further including:

charging the charge retentive surface, the developed latent image and the another developed latent image with the first corona generating device having the first purpose;

recording a third latent image on the charge retentive surface;

developing the third latent image on the charge retentive surface;

charging the charge retentive surface, the developed latent image, the another developed latent image and the third developed latent image with the first corona generating device having the first purpose;

recording a fourth latent image on the charge retentive surface; and developing the fourth latent image on the charge retentive surface.

18. A method for creating multiple images as claimed in claim 17, wherein the second purpose is for pretransfer treatment.

19. A method for creating multiple images in a printing machine comprising:

passing a charge retentive surface through at least two passes;

charging the charge retentive surface;

recording a first latent image on the charge retentive surface;

developing the first latent image on the charge retentive surface;

predetermining a first surface potential for recharging the charge retentive surface and the developed image thereto;

recharging the charge retentive surface with a first corona generating device to a higher absolute potential than the predetermined potential;

subsequently recharging the charge retentive surface and the developed image with a second corona generating device having a first purpose to the predetermined potential;

recording another latent image on the charge retentive surface;

developing the another latent image on the charge retentive surface; and charging the charge retentive surface with the second corona generating device having a second purpose in the last pass of the charge retentive surface.

20. A method for creating multiple images as claimed in claim 19, wherein the second purpose is for post-development purposes.

* * * * *